US007310826B2

(12) United States Patent
Kishihara

(10) Patent No.: US 7,310,826 B2
(45) Date of Patent: Dec. 25, 2007

(54) WORK GLOVE

(75) Inventor: Hidetoshi Kishihara, Himeji (JP)

(73) Assignee: Showa Glove Co. (JP)

( * ) Notice: Subject to any disclaimer, the term of this patent is extended or adjusted under 35 U.S.C. 154(b) by 13 days.

(21) Appl. No.: 11/302,887

(22) Filed: Dec. 14, 2005

(65) Prior Publication Data

US 2006/0130212 A1 Jun. 22, 2006

(30) Foreign Application Priority Data

Dec. 17, 2004 (JP) ..... 2004-365175

(51) Int. Cl.
*A41D 19/00* (2006.01)

(52) U.S. Cl. ..... 2/161.6; 2/16

(58) Field of Classification Search ..... 2/16, 2/20, 161.6
See application file for complete search history.

(56) References Cited

U.S. PATENT DOCUMENTS 4,497,072 A 2/1985 Watanabe ..... 2/161
5,581,812 A * 12/1996 Krocheski ..... 2/167
5,740,551 A * 4/1998 Walker ..... 2/16
6,928,658 B2 * 8/2005 Taira et al. ..... 2/161.6
2004/0221364 A1 * 11/2004 Dillard et al. ..... 2/159
2006/0143767 A1 * 7/2006 Yang et al. ..... 2/16

FOREIGN PATENT DOCUMENTS

| | | |
|---|---|---|
| DE | 4015164 | 11/1991 |
| DE | 10039887 | 11/2001 |
| EP | 0134484 | 3/1985 |

OTHER PUBLICATIONS

European Search Report for European Patent Application No. 05 25 7755, Mar. 14, 2006.

* cited by examiner

*Primary Examiner*—Katherine Moran
(74) *Attorney, Agent, or Firm*—Kusner & Jaffe

(57) ABSTRACT

A work glove including a glove base material made of fiber and a foam layer composed of a thermoplastic resin or a rubber provided thereon, the foam layer having irregularities formed by heat press on the surface is provided. Heat press induces collapse and thermal fusion of foam, leaving traces of the foam on the surface of a foamed material. The foam layer produced by this technique has both film strength and abrasion resistance without deterioration in the non-slip properties usually possessed by the foam layer.

8 Claims, 2 Drawing Sheets

WORK GLOVE

FIELD OF THE INVENTION

The present invention relates to a work glove used in applications requiring gripping properties.

BACKGROUND OF THE INVENTION

Conventionally, gloves produced by coating a knitted base glove made of natural fiber such as cotton or chemical fiber such as acryl and polyester with synthetic rubber, natural rubber or thermoplastic resin such as polyvinyl chloride have been widely used as work gloves. Some of these gloves have non-slip properties as a porous foam layer having an air content of about 10 to 65% is formed (e.g., Japanese Patent Laid-Open No. 63-243310). It is also proposed to apply foam latex to a base glove using a squeegee followed by hot curing to rubberize the same, or to apply liquid impermeable coating between the base glove and the resin layer (e.g., Japanese Patent Laid-Open No. 2002-201515) Generally, however, when thermoplastic resin or rubber contains foam, the film strength and the abrasion strength are reduced although non-slip properties are improved.

The present invention has been made in view of the above problem and aims at providing a work glove having excellent non-slip properties, film strength and abrasion resistance.

SUMMARY OF THE INVENTION

In accordance with the present invention, there is provided a work glove comprised of a glove base material made of fiber and a foam layer composed of a thermoplastic resin or a rubber provided thereon, wherein the foam layer has irregularities formed by heat press on the surface.

A liquid impermeable coating layer comprised of a thermoplastic resin or a rubber may be provided between the glove base material and the foam layer.

The glove base material made of fiber used in the present invention includes a sewn, knitted or non-woven fabric glove made of natural or chemical fiber such as cotton, wool, polyester, nylon, aramid or reinforced polyethylene.

The rubber used in the present invention includes natural rubber, homopolymers or copolymers such as isoprene, chloroprene, acrylic ester, styrene-butadiene copolymers, acrylonitrile-butadiene copolymers, polyurethane, butyl rubber, polybutadiene rubber and silicone rubber, or those blended with latex of a copolymer containing 10% by weight or less of carboxyl-modified group. The thermoplastic resin used in the present invention refers to a homopolymer or a copolymer of vinyl chloride or vinyl acetate.

In addition to a known cross-linking agent, vulcanization accelerator, antioxidant, thickener, or the like, a foaming agent or a foam stabilizer is added to the rubber. As a foaming agent, sodium alkyl sulfate, sodium alkyl ether sulfate, sodium dialkyl sulfosuccinate, N-lauroylamidopropyl dimethylbetaine, alkylamidopropyl dimethylamine oxide, N-alkylmonoamide disodium sulfosuccinate, potassium oleate, castor oil potassium, sodium dodecylbenzenesulfonate, or the like maybe used. As a foam stabilizer, polyoxyethylene alkylamino ether, sodium polyacrylate, ammoniumstearate, peptide, β-alanine, sodium alkyldipropionate, or the like may be used. Herein, alkyl means lauryl, octyl or stearyl. There may be no clear distinction between the foaming agent and the foam stabilizer.

To the thermoplastic resin may be added a chemical foaming agent, such as toluene sulfonyl hydrazide, PP'oxybis(benzosulfonyl hydrazide), azodicarbonamide and azobisisobutylonitrile, thermally expandable microspheres called microcapsules containing low boiling point hydrocarbon, or a silicone foam stabilizer, in addition to a known plasticizer, stabilizer, thickener, or the like. Thereto may also be added particles such as acrylic particles, urethane particles, natural rubber powder, EVA powder, PVC particles or NBR particles. These chemical foaming agents and particles such as microcapsules may also be added to the rubber.

In the present invention, heat press means pressing the intended portions in heat curing when forming a foam layer of thermoplastic resin or rubber. Specifically, with a foamed compound of thermoplastic resin or rubber being semi-cross linked and gelatinized by slight heat setting, a pressure of 1 to 100 kgf/cm$^2$ is applied at about 60 to 300° C. from the surface side using a metal or synthetic resin frame. Herein, heat setting means merely heating to solidify the material, which may results in drying, semi-cross linking, gelatinization, or heat curing. More specifically, a glove base material made of fiber is put on a hand-shaped frame and at least the palm side is coated with the foamed compound, and after the compound is semi-cross linked and gelatinized, physical projections and recesses are formed on the foam layer to be formed by lightly pressing the desired part of the surface during heat curing. This induces collapse and thermal fusion of foam, while traces of foam which exhibit non-slip properties are left on the surface, and thus can increase film strength and abrasion resistance. It is preferable to press the desired portion so that the foam content of the pressed portion is 10% to 90% of the foam content of the unpressed portion. In view of the abrasion resistance, it is preferable to perform pressing so that the thickness of the pressed portion is 50% of that of the unpressed portion.

The foam content can be optionally adjusted from 1% to 300% by stirring the compound using a foaming machine or a home use mixer. The foam content can be measured from specific gravity and it remains almost the same even after molding. When foaming is also mechanically induced not by using a chemical foaming agent alone, the number of foam is increased and many traces of foam (openings) are formed on the surface of the foam layer, and collapse and fusion of foam are more likely to occur upon heat press. When a glove has many traces of foam on the surface, water or oil present between the glove and the target is taken into the foam traces and removed, and thus the glove has better non-slip properties. When the foam content is 1% to 300%, the glove contains 10 to 130 pieces of foam having an average diameter of 10 μm to 400 μm per 1 cm$^2$ in the inside and on the surface. It is extremely difficult to produce foam having a diameter of less than 10 μm by mechanical foaming, and when the diameter is greater than 400 μm, the abrasion resistance becomes insufficient.

A patterned plate may be used as a frame upon heat press to produce irregularities on the surface. Alternatively, only part of the foam layer, e.g., part corresponding to finger tips of the glove, may be compressed using a flat plate. In the case of using a patterned plate, collapse and thermal fusion of foam can be induced by slightly pressing the surface of the foam layer by the projected portion of the plate, while many traces of foam can be left on the surface by slightly pressing the surface of the foam layer by the recessed portion, or preferably not pressing at all. The irregularities on the foam layer surface may be adjusted by the depth of the patterned plate. The thermal fusion may be confirmed by a microscope.

When disposing a liquid impermeable coating layer, a compound of the above-described thermoplastic resin or rubber is used after defoaming by stirring. Specifically, prior to formation of the foam layer, a glove base material put on a hand-shaped frame is coated with the defoamed compound by dipping or coating and the coated layer is dried or heat cured. In the present invention, "liquid impermeable" refers to the state which does not allow permeation of water in Water leak test according to EUROPEAN STANDARD EN 374. EUROPEAN STANDARD is available at Japanese Standards Association.

DETAILED DESCRIPTION OF PREFERRED EMBODIMENTS

The present invention shall be described in detail by means of Examples. These Examples are not intended to limit the scope of the present invention.

EXAMPLE 1

A compound of Formulation 1 described below was foamed by stirring using a household electronic hand-mixer so that the foam content was adjusted to 100%. The foam content was confirmed by measurement of specific gravity.

Knitted nylon base gloves were put on a hand-shaped dipping frame, dipped in a calcium nitrate solution, and only the palm side thereof was dipped in the foamed compound. The gloves were then heat set at 75° C. for 10 minutes and removed from the frame. It was confirmed that the foam layer formed on the surface of each base glove had a thickness of 0.4 mm and a foam content equal to that of the foamed compound.

Two gloves provided with the foam layer were each put on a flat frame. Only some regions of the palm and the finger tips of one glove were pressed by a flat plate, while almost the entire area of the palm side of the other glove was pressed at 1 kgf/cm$^2$ by a patterned plate on which recessed portions of 2 mm×3 mm×0.5 mm (depth) were formed at a density of 10 recesses/cm$^2$, and heat set was performed in that state at 120° C. for 20 minutes to create irregularities on the surface of the foam layer.

Figure 1A:
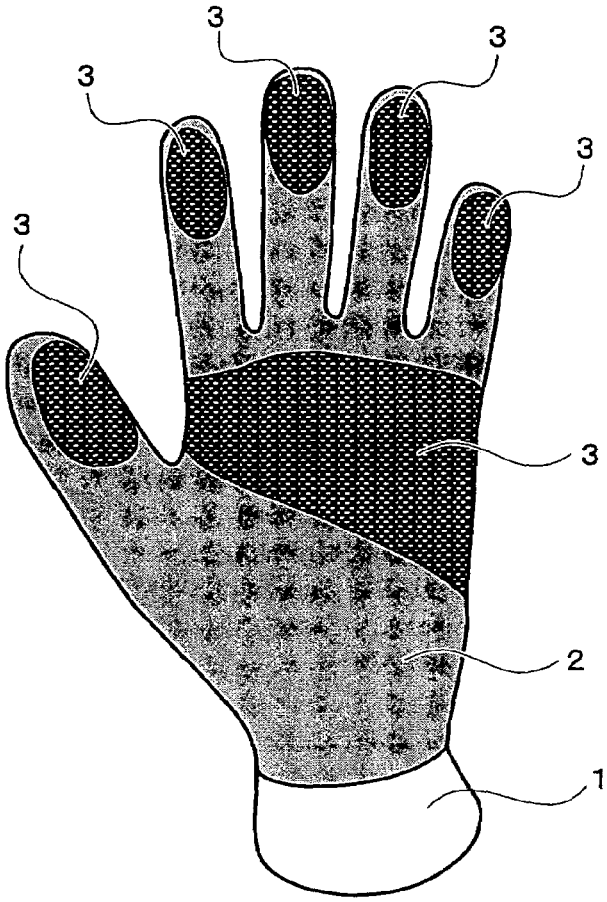
FIG. 1A is a plan view illustrating an appearance of the palm side of a work glove of the present invention.
Figure 1B:
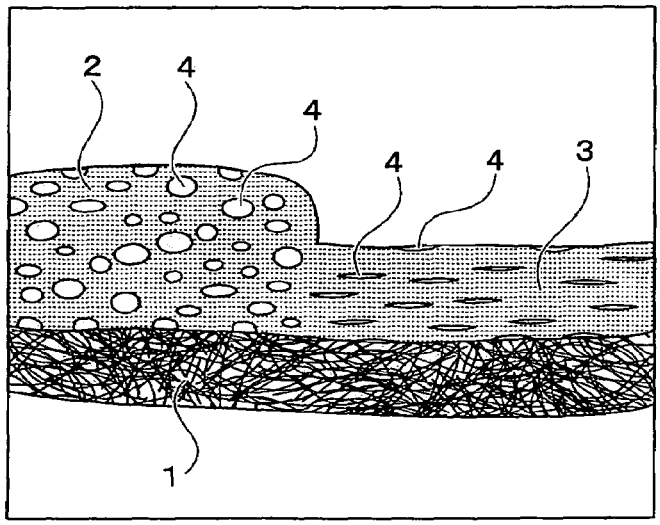
FIG. 1B is a cross section of the glove.
Figure 2A:
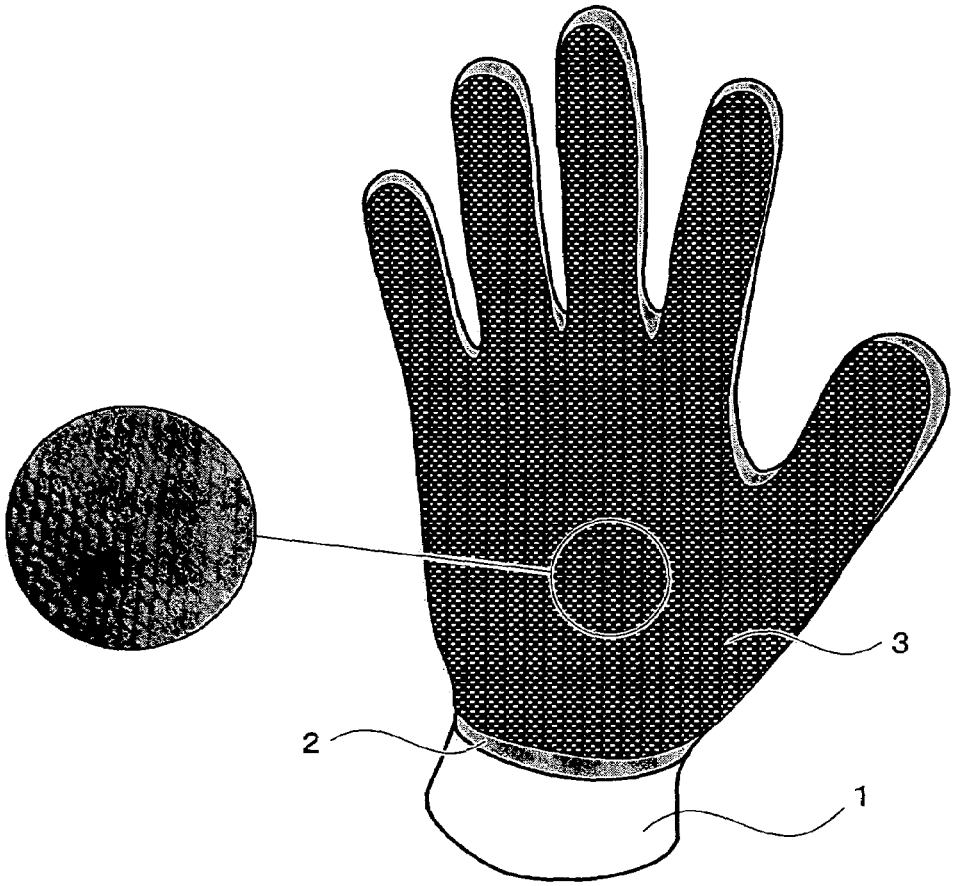
FIG. 2A is plan view illustrating an appearance of the palm side of another work glove of the present invention.
Figure 2B:
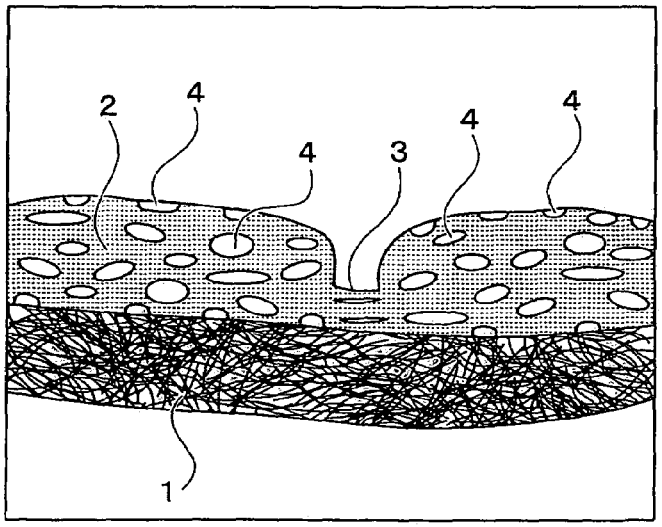
FIG. 2B is a cross section of the glove.

FIG. 1A shows the appearance of the palm side of the glove pressed by a flat plate and FIG. 1B shows a cross-section of the glove. FIG. 2A shows the appearance of the palm side of the glove pressed by a patterned plate and FIG. 2B shows a cross-section of the glove. In each figure, reference numeral 1 denotes a base glove, reference numeral 2 denotes a foam layer, reference numeral 3 denotes a pressed portion in the foam layer 2 and reference numeral 4 denotes foam or a trace of foam (opening). The gloves prepared in the following other Examples have a similar appearance and cross-section.

| Formulation 1 | |
|---|---|
| NBR latex *1 | 100 parts |
| colloidal sulfur *2 | 2.0 parts |
| zinc oxide *3 | 1.0 part |
| vulcanization accelerator (zinc dibutyldithiocarbamate) *4 | 0.5 part |
| antioxidant (2,2'-methylenebis(4-ethyl-6-tert-butylphenol) *5 | 0.5 part |
| pigment *6 | 0.3 part |
| thickener (polyacrylic acid ester) *7 | 0.2 part |
| foaming agent (sodium sulfosuccinate) *8 | 3.0 parts |
| foam stabilizer (sodium lauryldipropionate) *9 | 3.0 parts |

*1 Lx550 available from ZEON Corporation;
*2 available from Hosoi Kagaku Co., Ltd.;
*3 zinc oxide No. 2 available from Seido Chemical Industry Co., Ltd.;
*4 BZ available from Ouchi Narishige Shoten Co., Ltd.;
*5 BKF available from Bayer;
*6 SABlue 12402 available from Mikuni Color Ltd.;
*7 A-7070 available from Toa Gosei Co., Ltd.;
*8 Pelex TA available from Kao Corporation;
*9 Pionin C-158-D available from Takemoto Oil & Fat Co., Ltd.;
"part(s)" of each component means "part(s) by mass".

EXAMPLE 2

Gloves were prepared in the same manner as in Example 1 using a compound of the following Formulation 2.

| Formulation 2 | |
|---|---|
| NR latex *1a | 100 parts |
| colloidal sulfur *2 | 1.0 part |
| zinc oxide *3 | 0.5 part |
| vulcanization accelerator (zinc dibutyldithiocarbamate) *4 | 0.2 part |
| antioxidant (2,2'-methylenebis(4-ethyl-6-tert-butylphenol) *5 | 0.5 part |
| pigment *6 | 0.3 part |
| thickener (CMC) *7a | 0.1 part |
| foaming agent (sodium sulfosuccinate) *8 | 3.0 parts |
| foam stabilizer (sodium lauryldipropionate) *9 | 3.0 parts |

*1a LATZ available from BURITPERAK Co., Ltd.;
*7a Metolose 90SH30000 available from Shin-Etsu Chemical Co., Ltd.;
*2 to *6, *8, *9 are the same as those in Formulation 1.

EXAMPLE 3

Gloves were prepared in the same manner as in Example 1 using a compound of the following Formulation 3, except that a knitted cotton base glove was put on a hand-shaped frame, dipped in a calcium nitrate solution and the foamed compound, heat set at 190° C. for 5 minutes and then removed from the mold, then put on a flat frame and heat set at 190° C. for 5 minutes with pressing.

| Formulation 3 | |
|---|---|
| vinyl chloride paste resin *10 | 100 parts |
| plasticizer (alkyl sulfonic acid phenyl ester) *11 | 100 parts |
| epoxidized soybean oil *12 | 3 parts |
| stabilizer (Ca—Ba—Zn) *13 | 3 parts |
| thickener (anhydrous $SiO_2$) *14 | 0.2 part |
| foam stabilizer *15 | 20 parts |

*10 PSM-30 available from Kaneka Corporation (polymerization degree 1650);

-continued

| Formulation 3 |
|---|
| *11 Mesamoll available from Bayer; |
| *12 W-100 EL available from DIC; |
| *13 SWL-1 available from ASAHI DENKA Co., Ltd.; |
| *14 REOLOSIL QS102 available from Tokuyama Corporation; |
| *15 SH1250 available from Dow Corning Toray Co., Ltd. |

EXAMPLE 4

Gloves were prepared using a compound of the following Formulation 4 and a compound of the above-described Formulation 1. First, a knitted nylon base glove was put on a hand-shaped dipping frame and dipped in a calcium nitrate solution, and only the palm side thereof was dipped in the compound of Formulation 4. The glove was then heat set at 75° C. for 10 minutes, dipped in the compound of Formulation 1, heat set at 75° C. for 10 minutes and then removed from the frame to prepare gloves having a non-foamed layer and a foam layer stacked on the surface of the base glove.

Two gloves were each put on a flat frame as in Example 1, and heat set was performed with one being pressed by a flat plate and the other being pressed by a patterned plate to create irregularities on the surface of the foam layer.

| Formulation 4 | |
|---|---|
| NBR latex *1 | 100 parts |
| colloidal sulfur *2 | 2.0 parts |
| zinc oxide *3 | 1.0 part |
| vulcanization accelerator (zinc dibutyldithiocarbamate) *4 | 0.5 part |
| antioxidant (2,2'-methylenebis(4-ethyl-6-tert-butylphenol) *5 | 0.5 part |
| pigment *6 | 0.3 part |
| thickener (polyacrylic ester) *7 | 0.2 part |

*1 to *7 are the same as those in Formulation 1.

COMPARATIVE EXAMPLE 1

Gloves were prepared in the same manner as in Example 1 except that the foam layer was not heat pressed, i.e., heat set was performed without pressing.

COMPARATIVE EXAMPLE 2

Gloves were prepared in the same manner as in Example 2 except that the foam layer was not heat pressed.

COMPARATIVE EXAMPLE 3

Gloves were prepared in the same manner as in Example 3 except that the foam layer was not heat pressed.

COMPARATIVE EXAMPLE 4

Gloves were prepared in the same manner as in Example 4 except that the foam layer was not heat pressed.

The gloves in Examples 1 to 4 and Comparative Examples 1 to 4 were subjected to the following property tests and evaluated. The evaluation results are shown in Table 1. The foam layer (0.4 mm in thickness) on the surface of the glove is compressed to a thickness of 0.16 mm and a foam content of 40% under the above-described heat press condition. This was confirmed by separately pressing a foam layer having an area larger than that of the glove surface by a flat plate.

Abrasion Resistance

A test piece was cut out from the palm part of the glove and polished according to the Abrasion resistance test described in EUROPEAN STANDARDEN 388, and the number of polish at which the base glove was exposed was counted. The greater the number, the higher the abrasion resistance. The types of the polishing agent do not make any difference.

Gripping Property (Non-Slip Property)

The glove was worn and a metal bar coated with a fixed amount of cutting oil (Miyagawa 246) was gripped to examine the non-slip property. The property was evaluated based on the following four criteria. E: not slipped at all, G: not slippery, M: little slippery, P: slippery

TABLE 1

| | Press plate | Abrasion resistance number (times) | Non-slip property |
|---|---|---|---|
| Ex. 1 | flat plate | 1100 | G |
| | patterned plate | 800 | E |
| Ex. 2 | flat plate | 600 | G |
| | patterned plate | 500 | E |
| Ex. 3 | flat plate | 1500 | G |
| | patterned plate | 1000 | E |
| Ex. 4 | flat plate | 1200 | G |
| | patterned plate | 700 | E |
| Com. Ex. 1 | — | 300 | G |
| Com. Ex. 2 | — | 150 | G |
| Com. Ex. 3 | — | 500 | G |
| Com. Ex. 4 | — | 200 | G |

As described above, gloves prepared in Examples 1, Example 2, Example 3 and Example 4 have a foam layer heat pressed by a flat plate or a patterned plate. Further, in Examples land 2, the foam layers are made of rubber, in Example 3, the foam layer is made of a thermoplastic resin, and in Example 4, the foam layer and the non-foamed layer are made of rubber. As is evident from Table 1, these gloves have improved abrasion resistance which is about 2 to 6 times higher than that of the gloves of the corresponding Comparative Example 1, Comparative Example 2, Comparative Example 3 and Comparative Example 4, proving that they also have sufficient non-slip properties.

EXAMPLE 5

Using a compound of the above-described Formulation 1, gloves having a liquid impermeable coating layer between a base glove and a foam layer were prepared as follows.

The foam content of the compound of Formulation 1 was adjusted to 100% in the same manner as in Example 1. Another compound of Formulation 1 was adjusted to a temperature of about 25° C. to 30° C. and defoamed by stirring at 100 rpm or lower for 12 hours.

Knitted nylon base gloves were put on a hand-shaped dipping frame and dipped in a calcium nitrate solution, and only the palm side thereof was dipped in the defoamed compound. The gloves were then heat set at 75° C. for 10 minutes, dipped in the foamed compound, heat set at 75° C. for 10 minutes and then removed from the frame to prepare gloves having a liquid impermeable coating layer (non-foamed layer) and a foam layer stacked on the surface of the base glove.

The obtained two gloves were each put on a flat frame and heat pressed to create irregularities on the surface of the foam layer as in Example 1.

EXAMPLE 6

Using a compound of the above-described Formulation 2, gloves having a liquid impermeable coating layer between a base glove and a foam layer were prepared in the same manner as in Example 5.

EXAMPLE 7

Using a compound of the above-described Formulation 3, gloves having a liquid impermeable coating layer between a base glove and a foam layer were prepared in the same manner as in Example 5, except that knitted cotton base gloves were used and the compound of Formulation 3 defoamed by stirring in vacuo by a Henschel mixer for about 10 minutes was applied to the base gloves put on a hand-shaped frame and heat set was performed at 190° C. for 5 minutes to prepare the liquid impermeable coating layer.

The coated layers of the gloves of Examples 4 to 7 were subjected to Water leak test according to EUROPEAN STANDARD EN374, and as a result, it was confirmed that the films were impermeable to water.

Further, the coated layers of the gloves of Examples 1 to 7 were subjected to a moisture permeability test (JIS L 1099A-1), and as a result, the gloves of Examples 1 to 3 which have no liquid impermeable coating layer showed a value of 1000 to 10000 $g/m^2 \cdot 24$ hrs. While the portion pressed by a flat plate showed a value of 1000 $g/m^2 \cdot 24$ hrs, no humidity was felt in each glove as a whole, suggesting that good results were obtained.

What is claimed is:

1. A work glove comprised of:

a glove base material made of fiber;

a mechanically-foamed layer of rubber or a thermoplastic resin on said glove base material; and irregularities in the surface of said foamed layer, said irregularities comprised of projections and recesses formed on said foamed layer, said recesses formed by compressing said mechanically-foamed layer by heat press when said mechanically-foamed layer is semi-cross linked and gelatinized, said mechanically-foamed layer being compressed such that said recesses have 10% to 90% of the foam content of said projections and openings of traces of said foam are formed on the surface of said projections.

2. The work glove according to claim 1, wherein a liquid impermeable coating layer composed of a thermoplastic resin or a rubber is provided between the glove base material and the foam layer.

3. The work glove according to claim 1, wherein the foam layer has a pressed portion compressed to a thickness of about 50% relative to that of an unpressed portion.

4. The work glove according to claim 2, wherein the foam layer has a pressed portion compressed to a foam content of 10 to 90% by volume relative to that of an unpressed portion.

5. The work glove according to claim 2, wherein the foam layer has a pressed portion compressed to a thickness of about 50% relative to that of an unpressed portion.

6. The work glove according to claim 1, wherein the glove contains 10 to 130 pieces of foam having an average diameter of 10 μm to 400 μm per 1 $cm^2$ on the surface of the projected portion.

7. The work glove according to claim 2, wherein when disposing a liquid impermeable coating layer, a compound of the thermoplastic resin or rubber the same as in the foam layer is used after deforming by stirring.

8. The work glove according to claim 1, wherein recessed portions of 2 mm×3 mm×0.5 mm (depth) were formed at a density of 10 recesses/$cm^2$ on the entire area of the palm side of the glove to create the irregularities on the surface of the foam layer.

* * * * *